United States Patent [19]

Hinn

[11] 4,373,344

[45] Feb. 15, 1983

[54] METHODS AND APPARATUS FOR PRODUCING REFRIGERATION

[75] Inventor: John S. Hinn, Oakland, Calif.

[73] Assignee: Airco, Inc., Montvale, N.J.

[21] Appl. No.: 798,203

[22] Filed: May 18, 1977

[51] Int. Cl.[3] ..... F25D 25/00

[52] U.S. Cl. ..... 62/62; 62/168; 62/388

[58] Field of Search ..... 62/239, 384, 388, 514 R, 62/62, 168; 431/354; 239/DIG. 7

[56] References Cited

U.S. PATENT DOCUMENTS

| | | | |
|---|---|---|---|
| 2,893,216 | 7/1959 | Seefeldt et al. | 62/384 |
| 3,109,296 | 11/1963 | Williamson et al. | 62/514 R |
| 4,033,714 | 7/1977 | Longworth | 431/354 |
| 4,058,384 | 11/1977 | Keefe | 62/457 |

FOREIGN PATENT DOCUMENTS

| | | | |
|---|---|---|---|
| 684521 | 4/1964 | Canada | 62/388 |

*Primary Examiner*—Ronald C. Capossela

*Attorney, Agent, or Firm*—David L. Rae; Larry R. Cassett

[57] ABSTRACT

Refrigeration is produced by passing liquid carbon dioxide through a narrow slot into an enclosure or conduit having an inlet and an outlet in communication with ambient atmosphere. Liquid carbon dioxide is converted to solid and gaseous phases upon passage through the slot to produce a refrigeration effect and such phases are directed toward the enclosure exit thereby entraining ambient atmosphere in the solid and gaseous stream. This entrainment and mixing is effective to cause a relatively rapid sublimation of the solid carbon dioxide after exiting the enclosure and thus permits uniform refrigeration of a chamber into which the solid and gaseous carbon dioxide is discharged.

5 Claims, 2 Drawing Figures

METHODS AND APPARATUS FOR PRODUCING REFRIGERATION

BACKGROUND OF THE INVENTION

The present invention relates to methods and apparatus for producing refrigeration and more particularly to methods and apparatus for refrigerating a chamber by discharging carbon dioxide therein.

Numerous methods and systems for providing refrigeration to a chamber have been developed. One common type of system is a "mechanical" refrigeration unit in which expansion of a circulating working fluid, such as a fluorinated halocarbon, effects a cooling of such fluid so that upon heat exchange between air and the fluid, air may be chilled and in turn be utilized to refrigerate a chamber. The motive power for such systems is typically supplied by an internal combustion engine or electric motor. Other systems include apparatus for discharging a cryogenic fluid such as liquid nitrogen (typically at −320° F.) into a chamber or discharging liquid carbon dioxide from a nozzle or "snow horn" into a chamber. Such latter discharge or expansion results in the conversion of liquid carbon dioxide to solid and gaseous phases (−109° F.) although fans are required to suspend particles of solid $CO_2$ until the same sublimate in order to obtain uniform refrigeration of a particular chamber. Still another type of refrigeration system includes a coil or other vaporizer for vaporizing liquid nitrogen or liquid carbon dioxide to drive a pneumatic motor which in turn drives a fan to blow air across the coil containing such liquid thereby cooling the air which is then utilized to refrigerate a chamber. The nitrogen or carbon dioxide gas is simply vented after driving the pneumatic motor.

Although the aforedescribed systems will operate to produce refrigeration, each has one or more drawbacks that tend to restrict its use. For example, the "mechanical" refrigeration units require relatively high capital costs as a result of utilizing a compressor and expander, etc. Furthermore, when such units are subjected to substantial vibration as will occur during use with over the road trailers, equipment reliability is less than desirable and maintenance costs are relatively high. Mechanical refrigeration units are heavy and when driven by internal combustion engines as is typically the case when used with over the road trailers, such systems are noisy and release undesirable exhaust emissions. Liquid nitrogen refrigeration systems require a supply of this cryogen and are expensive to operate. In the course of filling storage vessels with liquid nitrogen, nitrogen gas must be vented thereby causing substantial losses of this cryogen and increased overall costs. In addition, due to the low temperature (−320° F.) of liquid nitrogen, storage vessels require considerable insulation and must be constructed of relatively expensive materials, e.g. stainless steel. Use of liquid nitrogen systems does not result in circulation of the atmosphere of the chamber in which such systems are disposed and frequently results in intense localized cooling. Although snow horns or nozzles are effective to discharge a stream of solid and gaseous carbon dioxide, these devices are generally not effective to uniformly refrigerate a chamber due to the tendency of the solid carbon dioxide (snow) to settle on the chamber floor or contact items being refrigerated therein without the use of elaborate control systems requiring external power sources. Although fans may be disposed in the chamber to maintain the snow suspended in the atmosphere thereof until the snow sublimates, fans represent costly additional equipment. Furthermore, as fans perform work in the chamber, heat is effectively supplied to the chamber thereby resulting in a greater consumption of liquid carbon dioxide in order to maintain a predetermined temperature in the chamber.

Accordingly, a clear need exists for a refrigeration system, which is structurally simple, light in weight, clean with respect to the emission of pollutants, quiet and reliable in operation even when subject to substantial vibrations and which is yet effective to uniformly refrigerate a chamber without consuming excessive quantities of refrigerants.

OBJECTS OF THE INVENTION

It is an object of the invention to provide improved methods and apparatus for producing refrigeration.

It is another object of the invention to provide methods and apparatus for uniformly refrigerating a chamber by discharging carbon dioxide therein.

It is a further object of the invention to reliably, yet with simplified structure, dispense carbon dioxide as a refrigerant.

It is still another object of the invention to provide methods and apparatus for controlling the degree of refrigeration obtained from dispensing a stream of solid and gaseous carbon dioxide into a chamber.

It is an additional object of the present invention to provide methods and apparatus for producing a stream of carbon dioxide snow with the snow subliming rapidly thereby avoiding regions of locally intense refrigeration in a chamber.

Other objects of the present invention will become apparent from the detailed description of an exemplary embodiment thereof which follows and the novel features of the invention will be particularly pointed out in conjunction with the claims appended hereto.

SUMMARY

In accordance with the present invention, a method for producing refrigeration comprises the steps of passing liquid carbon dioxide through a slot in enclosure means having an inlet and an outlet in communication with ambient atmosphere in a chamber, thereby forming a stream of solid and gaseous carbon dioxide which is directed toward said outlet, entraining ambient atmosphere through said inlet and into said stream and discharging said stream and entrained atmosphere from said outlet to provide refrigeration in said chamber.

The foregoing method, and apparatus therefor, enables the uniform refrigeration of a chamber as a consequence of the entrained ambient atmosphere mixing with and heating the carbon dioxide solid and gas stream thereby subliming substantially all of the solid $CO_2$ or snow before such snow contacts items to be refrigerated. In this manner the refrigeration available from both the solid and gas phases of the discharged carbon dioxide stream is imparted to the ambient atmosphere (of a chamber). In addition, the discharged stream is effective, by kinetic energy, and to some extent convection, to move this atmosphere and thereby promote a uniform refrigeration thereof.

The temperature in a chamber may be maintained at a predetermined value by sensing the actual temperature therein, comparing the sensed temperature with the predetermined value and supplying liquid carbon dioxide to the slot in the event the sensed temperature is greater than the predetermined value.

BRIEF DESCRIPTION OF THE DRAWING

The invention will be more clearly understood by reference to the following description of exemplary embodiments thereof in conjunction with the following drawing in which.

DESCRIPTION OF PREFERRED EMBODIMENT

Figure 1:
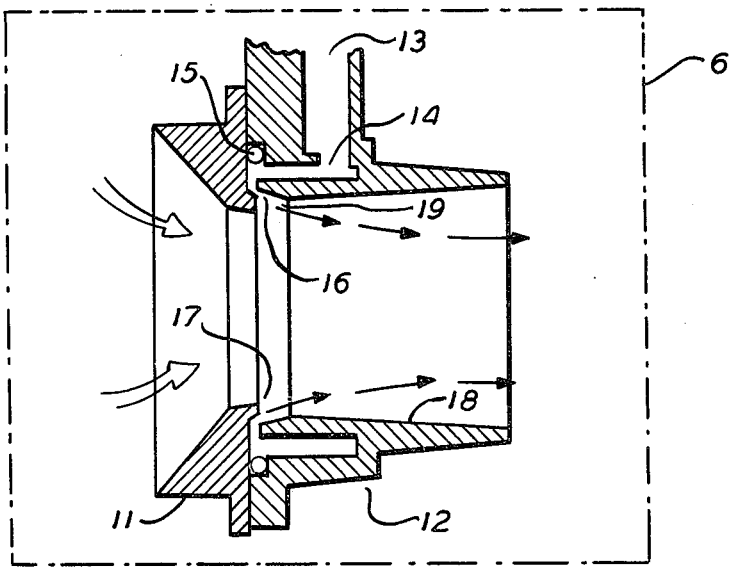
FIG. 1 is an elevational view of a device for converting carbon dioxide to a solid and gas stream and for entraining ambient atmosphere into such stream.

Referring now to FIG. 1, illustrated therein is an exemplary embodiment of a device suitable for discharging solid and gaseous carbon dioxide into a chamber to be refrigerated in accordance with the method of the present invention. The device, which may take the form of an air-flow amplifier, includes an inlet 11 and body 12. Suitable air-flow amplifiers are commercially available from Vortec Corporation, Cincinnati, Ohio and are described in U.S. Pat. No. 4,046,492. An additional inlet 13 (for liquid carbon dioxide) is disposed in communication with a plenum 14 which may be annular or of other convenient geometries. Plenum 14 communicates with the interior of device 10 through a narrow annular slot 16 which is formed between a lip 17 and one end of throat portion 18 of body 12. Throat portion 18 and inlet 11 cooperate (by retaining means not shown) to form an enclosure or conduit-like passage with inlet 11 and the end of throat 18 remote from slot 16 constituting the inlet and outlet, respectively of the enclosure. It will be understood that although the foregoing enclosure or conduit-like passage is comprised of two portions (inlet 11 and body 12 sealed by an O-ring 15) such enclosure may be formed as a single element.

Slot 16, which may be formed in configurations other than annular, is between approximately 0.002–0.006 inch wide and preferably is approximately 0.004 inch wide. This latter width has been found effective in enabling the passage of liquid carbon dioxide into the passage or enclosure formed by inlet 11 and throat 18. Lip 17 is preferably disposed to face, at least partially, bevelled surface 19 of throat 18 to direct the stream emanating from slot 16 toward the right hand end of throat 18 as will be subsequently described in greater detail.

In order to produce refrigeration (i.e. maintain a desired temperature in chamber 6, notwithstanding heat leaks into chamber 6 or to lower the temperature therein) by operation of device 10, liquid carbon dioxide is supplied through inlet 13 to plenum 14, preferably under a pressure within the range of approximately 225–300 p.s.i.g., although this particular pressure is not critical. Liquid carbon dioxide is then expanded upon flowing through slot 16 to form a stream of solid and gaseous carbon dioxide which is directed by lip 17 and bevelled surface 19 to the outlet of throat 18 generally along the direction of the small arrows illustrated in FIG. 1 and into chamber 6. This stream is not believed to fill the entire volume of throat 18, but rather ideally moves through throat 18 in the form of a cylindrical sheet. This movement is believed to create a low pressure adjacent to the stream in the central portion of throat 18 which results in the entrainment of considerable quantities of ambient atmosphere through inlet 11 into throat 18 as will occur upon operation of device 10 as an air-flow amplifier. The entrainment of ambient atmosphere (which may be air external to chamber 6 or $CO_2$ enriched air in chamber 6 being refrigerated) is effective to reduce the velocity of stream discharged from throat 18. More importantly, the entrained ambient atmosphere is mixed with and is effective to impart heat to this stream thereby subliming solid carbon dioxide particles before the same contact items to be refrigerated (not shown). In this manner locally intense refrigeration (−109° F.) which can occur upon contact between solid $CO_2$ and such items is avoided and substantially uniform refrigeration of a chamber may be effected. For example, during tests chamber 6 has been maintained at a temperature of 40° F. by discharging a stream of air entrained in $CO_2$ solid and gas (having a temperature of −109° F. at slot 16) with the temperature at a distance of 6 ft. from the exit end of throat 18 being measured at 25° F. with essentially no snow falling to the chamber floor.

Although a width of slot 16 of 0.004 inch is preferred, other widths may be utilized. However, it has been found that upon supplying liquid carbon dioxide to inlet 13 at a pressure within the range of approximately 225–300 p.s.i.g. a slot width of 0.004 inch will provide a sufficient rate of flow of liquid $CO_2$ into throat 18 to produce a desired degree of refrigeration. In addition, it has been found that pre- and post-gas purging of the liquid $CO_2$ line with gas is unnecessary when on-off valves are connected in close proximity to inlet 13.

Figure 2:
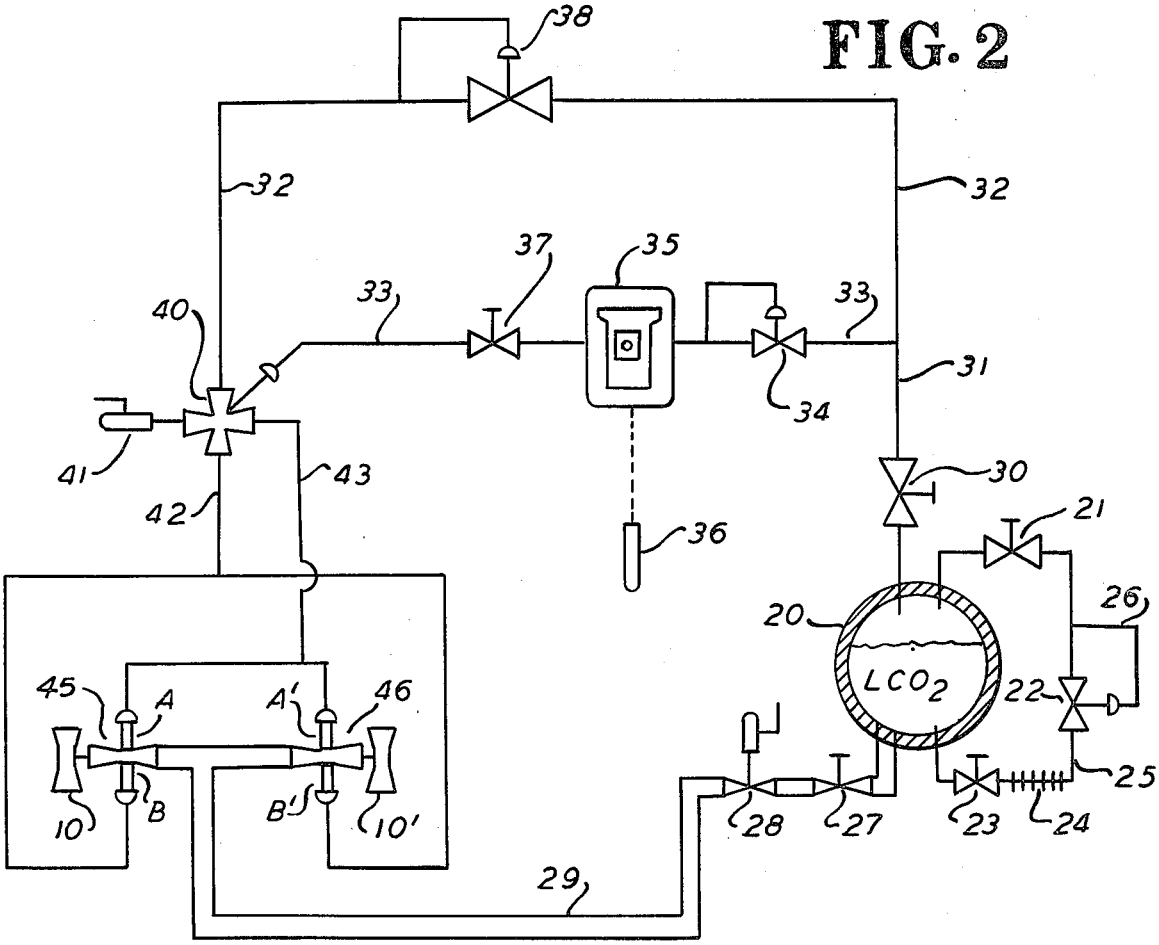
FIG. 2 is a diagrammatic view of a system for controlling the supply of liquid carbon dioxide to the device depicted in FIG. 1.

Referring now to FIG. 2, illustrated therein is an exemplary embodiment of a system for supplying liquid carbon dioxide to dispensing elements such as device 10 (FIG. 1). More particularly, a suitably insulated vessel 20 which is preferably capable of retaining liquid carbon dioxide under a pressure within the range of approximately 225–300 p.s.i.g. is provided with a pressure building circuit comprised of valves 21 and 23, coil or vaporizer 24, pressure regulator 22 and gas line 26. As those skilled in the art will appreciate, as liquid $CO_2$ is removed from vessel 20, the pressure therein decreases. Typically, a predetermined pressure (and corresponding equilibrium temperature) within the foregoing range are maintained to provide a constant motive pressure on liquid $CO_2$ in vesssel 20 as well as avoid flashing of liquid to solid in vessel 20. A small flow of liquid is passed through valve 23, vaporized in coil 24 and passed through regulator 22. The gas pressure downstream of regulator 22 is sensed by line 26 which enables regulator to pass gaseous carbon dioxide through valve 21 to the head space of vessel 20. By setting regulator 22 to a pressure within the range of 225–300 p.s.i.g. such pressure will be maintained in vessel 20. A safety valve (not shown) is preferably disposed in line 25 and regulator 22 may be positioned upstream of coil 24 if desired.

Liquid carbon dioxide is supplied from vessel 20 through on-off valve 27, safety valve 28 and line 29 through double acting pneumatic valves 45 and 46 to devices 10 and 10' (FIG. 1), respectively. Line 29 may comprise any conduit insulated and adapted to withstand a pressure of at least 225–300 p.s.i.g. Although double acting valves 45 and 46 are preferred due to the positive action and quick operation thereof, other types of on-off valves capable of selectively passing liquid carbon dioxide may be used as well.

In order to enable a reliably controlled application of liquid carbon dioxide to devices 10 and 10', a gas line 31 is coupled through on-off valve 30 to the head space of vessel 20. Line 31 is preferably divided to form lines 32 and 33 each of which terminates at valve 40. A pressure regulator 38 is disposed in line 32 to reduce the pressure therein from approximately 225–300 p.s.i.g. to about 40 p.s.i.g. which latter gas pressure is supplied to one inlet of valve 40. A pressure regulator is connected in line 33 for the purpose of reducing the pressure therein to approximately 25 p.s.i.g. which pressure is supplied to controller 35 which may comprise a temperature controller such as Model ZCQA produced by Partlow, Inc. Controller 35 is provided with a temperature probe 36 and as those skilled in the art will appreciate, upon probe 36 sensing a temperature above the temperature to which controller 35 is set, the 25 p.s.i.g. gas pressure is passed through controller 35 and on-off valve 37 to a further inlet of valve 40.

Valve 40, which is provided with a vent valve 41, is preferably a four-way valve that is effective upon the presence of gas pressure (25 p.s.i.g.) in line 33 to pass the gas pressure (40 p.s.i.g.) in line 32 through one outlet and, for example, over line 43 to pneumatic operators A and A′ of valves 45 and 46, respectively. In the absence of a gas pressure in line 33, the pressure in line 32 is relieved at the station of valve 40 associated with valve 41 and is then passed through another outlet 42 of valve 40 to operators B and B′ of valves 45 and 46, respectively.

In operation of the system illustrated in FIG. 2, valves 21 and 23 are opened to enable regulator 22 to maintain a predetermined pressure in vessel 20. Valves 30 and 37 are opened to cause the gas pressure in line 32 to be supplied to one inlet of four-way valve 40 as mentioned above. In the event that probe 36 detects a temperature in a chamber (not shown) greater than the temperature to which controller 35 has been set, controller 35 is effective to pass the gas pressure in line 33 at the outlet of regulator 34 (e.g. 25 p.s.i.g.) to a further inlet of valve 40. Assuming that actuation of operators A and A′ is effective to open valves 45 and 46, respectively, valve 40 is effective upon the presence of pressure in line 33 to pass the pressure in line 32 to line 43 thereby actuating operators A and A′. Valves 45 and 46 are thus positively opened and liquid carbon dioxide is permitted to flow therethrough (from line 29) to devices 10 and 10′ thereby providing refrigeration to the chamber (not shown). Upon the temperature in such chamber decreasing below the temperature set on controller 35, the pressure at the outlet of regulator 34 will not be passed by controller 35 and the pressure previously supplied in line 33 to valve 40 is relieved. Accordingly, valve 40 is then effective to pass the pressure in line 32 to line 42 which in turn supplies such pressure to operators B and B′ of valves 45 and 46, respectively. Operators B and B′ are thus actuated to close valves 45 and 46, respectively, thereby terminating the flow of liquid $CO_2$ to devices 10 and 10′ until probe 36 detects the presence of a temperature in the chamber (not shown) above the temperature to which controller 35 is set, at which time, valves 45 and 46 are opened as previously mentioned.

It will be understood that although two devices 10 and 10′ are illustrated in FIG. 2, the present invention is not limited to this number of devices 10. For example, a single device 10 or three or more such devices may be supplied with liquid carbon dioxide in a manner similar to the aforedescribed system illustrated in FIG. 2. In addition, although valve 40 and controller 35 operate on gas pressures of 40 p.s.i.g. and 25 p.s.i.g., respectively, the use of valves and controllers operating on other pressures is clearly within the scope of the present invention.

The foregoing and other various changes in form and details may be made without departing from the spirit and scope of the present invention. Consequently, it is intended that the appended claims be interpreted as including all such changes and modifications.

What is claimed is:

1. A method for producing refrigeration comprising the steps of providing enclosure means having an internal passage between an inlet and an outlet in communication with ambient atmosphere; passing liquid carbon dioxide through a slot formed in said enclosure means peripherally of said internal passage to form a stream of carbon dioxide solid and gas interiorly of said enclosure means; directing said stream toward the outlet of said enclosure means; entraining ambient atmosphere through said inlet interiorly of and into said stream; and discharging said stream and entrained atmosphere from said outlet to thereby produce refrigeration.

2. The method as defined in claim 1 additionally comprising the steps of disposing said enclosure means in a chamber and placing items to be refrigerated in said chamber, and wherein substantially all of said solid carbon dioxide in said stream sublimes before said solid contacts said items to be refrigerated.

3. The method as defined in claim 2 additionally comprising the steps of sensing the temperature in said chamber and controlling the flow of liquid carbon dioxide to said enclosure means in response to said sensed temperature to thereby maintain a predetermined temperature in said chamber.

4. The method as defined in claim 1 wherein said step of passing liquid carbon dioxide through said slot comprises passing liquid carbon dioxide to said slot under a pressure within the range of approximately 225–300 p.s.i.g.

5. The method as defined in claim 1 wherein said slot is substantially annular and said step of passing liquid carbon dioxide to said slot includes forming a substantially cylindrical stream of carbon dioxide solid and gas such that ambient atmosphere is entrained through said inlet into the interior of said cylindrical stream.

* * * * *